US008302832B2

(12) United States Patent
Porth et al.

(10) Patent No.: US 8,302,832 B2
(45) Date of Patent: Nov. 6, 2012

(54) FASTENER FEEDER DELAY FOR FASTENER DRIVING TOOL

(75) Inventors: Chris H. Porth, Gurnee, IL (US); Larry M. Moeller, Mundelein, IL (US)

(73) Assignee: Illinois Tool Works Inc., Glenview, IL (US)

( * ) Notice: Subject to any disclaimer, the term of this patent is extended or adjusted under 35 U.S.C. 154(b) by 343 days.

(21) Appl. No.: 12/760,251

(22) Filed: Apr. 14, 2010

(65) Prior Publication Data

US 2010/0258608 A1 Oct. 14, 2010

Related U.S. Application Data

(63) Continuation-in-part of application No. 11/820,942, filed on Jun. 21, 2007.

(51) Int. Cl.
*B25C 1/08* (2006.01)

(52) U.S. Cl. ..... 227/120; 227/9; 227/10; 227/136

(58) Field of Classification Search ..... 227/10, 227/9, 120, 136

See application file for complete search history.

(56) References Cited

U.S. PATENT DOCUMENTS

| | | | |
|---|---|---|---|
| 1,877,162 | A | 9/1932 | Day |
| 2,572,012 | A | 10/1951 | Curtis |
| 3,930,297 | A | 1/1976 | Potucek et al. |
| 4,403,722 | A | 9/1983 | Nikolich |
| 4,442,965 | A | 4/1984 | Leistner |
| 4,483,473 | A | 11/1984 | Wagdy |
| 4,483,474 | A | 11/1984 | Nikolich |
| 4,522,162 | A | 6/1985 | Nikolich |
| 5,197,646 | A | 3/1993 | Nikolich |
| 5,558,264 | A | 9/1996 | Weinstein |
| 6,041,992 | A | 3/2000 | Poinelli et al. |
| 7,040,521 | B2 | 5/2006 | Kolodziej et al. |
| 2003/0034377 | A1 | 2/2003 | Porth et al. |

*Primary Examiner* — Brian D Nash
*Assistant Examiner* — Michelle Lopez
(74) *Attorney, Agent, or Firm* — Greer, Burns & Crain, Ltd.; Patty Chidiac; Mark W. Croll

(57) ABSTRACT

A fastener driving tool includes a power source including a cylinder, a piston with a driver blade reciprocating in the cylinder, a tool nose associated with the power source for receiving the driver blade for driving fasteners fed into the nose, and a magazine housing a supply of the fasteners. A magazine feeder mechanism is associated with the magazine for sequentially feeding fasteners into the nose, and the feeder mechanism includes a reciprocating feed piston. A conduit is connected between a port in the cylinder and the feed mechanism for diverting combusted gas for activating the feed piston. The port is disposed in the cylinder a specified distance below a piston prefiring position, and the distance is reflective of a delay of feeding the gas to the feed piston at least until engagement between an end of the driver blade and a head of a fastener in the tool nose.

12 Claims, 13 Drawing Sheets

FASTENER FEEDER DELAY FOR FASTENER DRIVING TOOL

RELATED APPLICATION

This application is a Continuation-In-Part of U.S. patent application Ser. No. 11/820,942 filed Jun. 21, 2007.

BACKGROUND OF THE INVENTION

The present invention relates generally to fastener driving tools employing magazines feeding fasteners to a nosepiece for receiving a driving force; and more specifically to such tools employing a fastener feeder mechanism powered with gas pressure generated during the fastener driving process.

Fastener driving tools, referred to here as tools or nailers, are known in the art and are powered by combustion, compressed gas (pneumatic), powder, and electricity. Portable fastener driving tools that drive collated fasteners disposed in a coil magazine are commercially available on the market and are manufactured by ITW Buildex, Itasca, Ill. The core operating principle of the tool and the respective fastener feeding mechanism is defined in ITW U.S. Pat. Nos. 5,558,264 and 7,040,521, both of which are incorporated by reference. In U.S. Pat. No. 5,558,264, a gas conduit is placed in fluid communication with the main drive cylinder of the power source.

Upon ignition and combustion, as the drive piston attached to the driver blade travels down the cylinder toward the fastener or nail to be driven, a supply of combustion gas is distributed into the gas conduit and is used to operate a spring-biased feeder mechanism. The gas pressure overcomes a biasing force provided by a spring, and causes movement of a feed piston located within a feed cylinder and connected to a feeding claw. Operationally associated with a strip of collated fasteners, the burst of compressed gas causes the feed piston and a linked feeding claw to retract and engage the next fastener in the strip. Next, upon dissipation of the combustion gas, the compressed spring expands, advances the feed piston and the next fastener toward the tool nosepiece for subsequent engagement with the driver blade.

In the '264 patent, the gas conduit is located in a wall of the drive cylinder and positioned between the drive piston's uppermost location (pre-firing position) and exhaust port openings located closer to an opposite end of the drive cylinder. The position of the conduit is such that a designated timing relationship is established during the drive cycle between the relative displacement of the drive piston and that of the feeder mechanism's feed piston. Such timing is an important design parameter for obtaining effective nail control and preventing nail jams within the nosepiece or the magazine. Optimally, the drive piston shears the nail from the collation media before the feed piston begins retraction, otherwise the nail will be driven with less control and an unsatisfactory nail drive can result. However, the mechanism of the '264 patent proved to be less reliable in that insufficient pneumatic power was supplied to the feed piston. The '521 patent disclosed moving the feed piston supply conduit inlet port directly in the combustion chamber to obtain a greater pneumatic force. A drawback of this arrangement is that the feed piston is actuated prematurely, causing misaligned fasteners in the tool nose as well as improperly driven fasteners.

Once the nail driving process is complete, a subsequent timing relationship between the return of the drive piston and advancement of the feeder mechanism is also important to obtain reliable piston return and nail feeding. The preferred timing scenario is for the drive piston to return to the prefiring position before the feeder mechanism advances the nail into the tool nosepiece or nose (the terms are considered interchangeable). Currently, the feeder mechanism attempts to advance the nail into the nose while the drive piston and driver blade is returning to the pre-firing position. More specifically, the feed piston urges the next fastener toward the nosepiece prior to full retraction of the drive piston. This results in the nail being biased against the driver blade during the return cycle. See FIG. 6 and its associated description for timing diagram details. Between t2 and t3, the feed piston is urging the next fastener against the driver blade as the drive piston returns to its prefiring position. Only when the driver blade is fully retracted to its pre-firing position and a clear fastener passageway is provided does the fastener reach its drive position, indicated at t3. It should be understood that, referring to FIG. 6, as well as the other timing diagram in the application, that while tool state transitions are shown occurring instantaneously, there may be relative discrepancies or delays between steps.

The feeder mechanism includes a biasing spring that indirectly acts on the next nail to be driven, thereby exerting a transverse load component on the blade. The resulting friction prolongs the return of the driver blade, or even worse, prevents the driver blade from returning to the pre-firing position. When this occurs, the next fastener drive cycle does not result in a fastener being driven. This problem can be exacerbated by the amount of dirt, debris or collation media in the nose area of the tool.

Thus, there is a need for an improved fastener driver tool employing a method of establishing a preferred timing relationship between the drive piston and the advancement of the feeder mechanism during the return cycle of the drive piston.

SUMMARY

The above-listed needs are met or exceeded by the present feeder mechanism retention device for a fastener driving tool, which, in the preferred embodiment, features an electromechanical retention device and a control module that accommodates complete drive piston return before the feeder mechanism advances a nail into the tool nose. The present fastener driving tool uses a gas conduit that receives a supply of gas pressure from the power source, typically generated by combustion, and transmits the gas to the feed cylinder to overcome the feed piston return spring, thus retracting the feed piston, and uses an electromagnet for retaining the feed piston in the retracted position until the drive piston has returned to its pre-firing position or soon thereafter.

Advantages of the present tool include reduced nail or collation malfunction due to interference with the driver blade during piston return, improved piston return speed and reliability due to reduced frictional load on the drive piston assembly, and increased operational life for the drive piston and the retention device due to low wear. Also, the retention device is lightweight and operates with increased energy efficiency compared to conventional fastener feeder mechanisms. The present device is relatively uncomplicated with few parts to produce, install and maintain, and it is substantially enclosed, resulting in a dirt and debris-tolerant assembly, as opposed to prior art designs, which use small gas passages that are prone to dirt problems and complex mechanisms that can be damaged, require lubricant, are susceptible to corrosion, and can be affected by debris. In the present tool, the control module provides electronically controlled automatic operation of the retention device, and end-user input variability is avoided. Lastly, by providing a relatively simple mechanism which is operable independently of the normal tool functions, the tool actuation force required to be applied by the user prior to driving a fastener is maintained as in conventional tools and is not increased.

In addition, the gas conduit is connected to the cylinder to obtain sufficient pneumatic force for actuating the magazine feed cylinder, while effectively delaying the actuation of the feeder mechanism feed piston until the driver blade has sufficiently impacted the fastener. It is preferred that the feed piston be delayed until the collations holding the fasteners together are broken. An advantage of this delay is that fastener misalignment is prevented, which reduces fastener jams in the nose and also results in more effective fastener driving. This delay is obtained by moving the port that feeds combustion gas to the feed piston a specified distance below the piston pre-firing position such that the gas is delivered to the feed piston only after the driver blade has impacted the fastener. In other words, the distance the port is displaced below the pre-firing position is determined by the delay in actuating the feed piston, based on driver blade position.

More specifically, a fastener driving tool includes a power source including a cylinder, a piston with a driver blade reciprocating in the cylinder, a tool nose associated with the power source for receiving the driver blade for driving fasteners fed into the nose, and a magazine housing a supply of the fasteners. A magazine feeder mechanism is associated with the magazine for sequentially feeding fasteners into the nose, and the feeder mechanism includes a reciprocating feed piston. A conduit is connected between a port in the cylinder and the feed mechanism for diverting combusted gas for activating the feed piston. The port is disposed in the cylinder a specified distance below a piston prefiring position, and the distance is reflective of a delay of feeding the gas to the feed piston at least until engagement between an end of the driver blade and a head of a fastener in the tool nose.

In another embodiment, a fastener driving tool is provided and includes a power source including a cylinder, a piston with a driver blade reciprocating in the cylinder, a tool nose associated with the power source for receiving the driver blade for driving fasteners fed into the nose, and a magazine constructed and arranged to house a supply of the fasteners, the fasteners being connected to each other by collation media. A magazine feeder mechanism is associated with the magazine for sequentially feeding fasteners into the nose, the feeder mechanism including a reciprocating feed piston. A conduit is connected between a port in the cylinder and the feed mechanism for diverting combusted gas from the cylinder for activating the feed piston, the port is disposed in the cylinder a specified distance below a piston prefiring position. The distance being reflective of a delay of feeding the gas to the feed piston at least until sufficient engagement between an end of the driver blade and a head of a fastener in the tool nose for breaking the collation media.

In still another embodiment, a fastener driving tool is provided, including a power source including a cylinder, a drive piston with a driver blade reciprocating in the cylinder, a tool nose associated with the power source for receiving the driver blade for driving fasteners fed into the nose, and a magazine constructed and arranged to house a supply of the fasteners. A magazine feeder mechanism is associated with the magazine for sequentially feeding fasteners into the nose, the feeder mechanism including a reciprocating feed piston. A conduit is connected between a port in the cylinder and the feed mechanism for diverting combusted gas from the cylinder for activating the feed piston. The port is disposed in the cylinder a specified distance below a piston prefiring position, the distance being reflective of a delay of activating the feed piston until the drive piston finishes a driving stroke and begins a return to the prefiring position.

DETAILED DESCRIPTION

Figure 1:
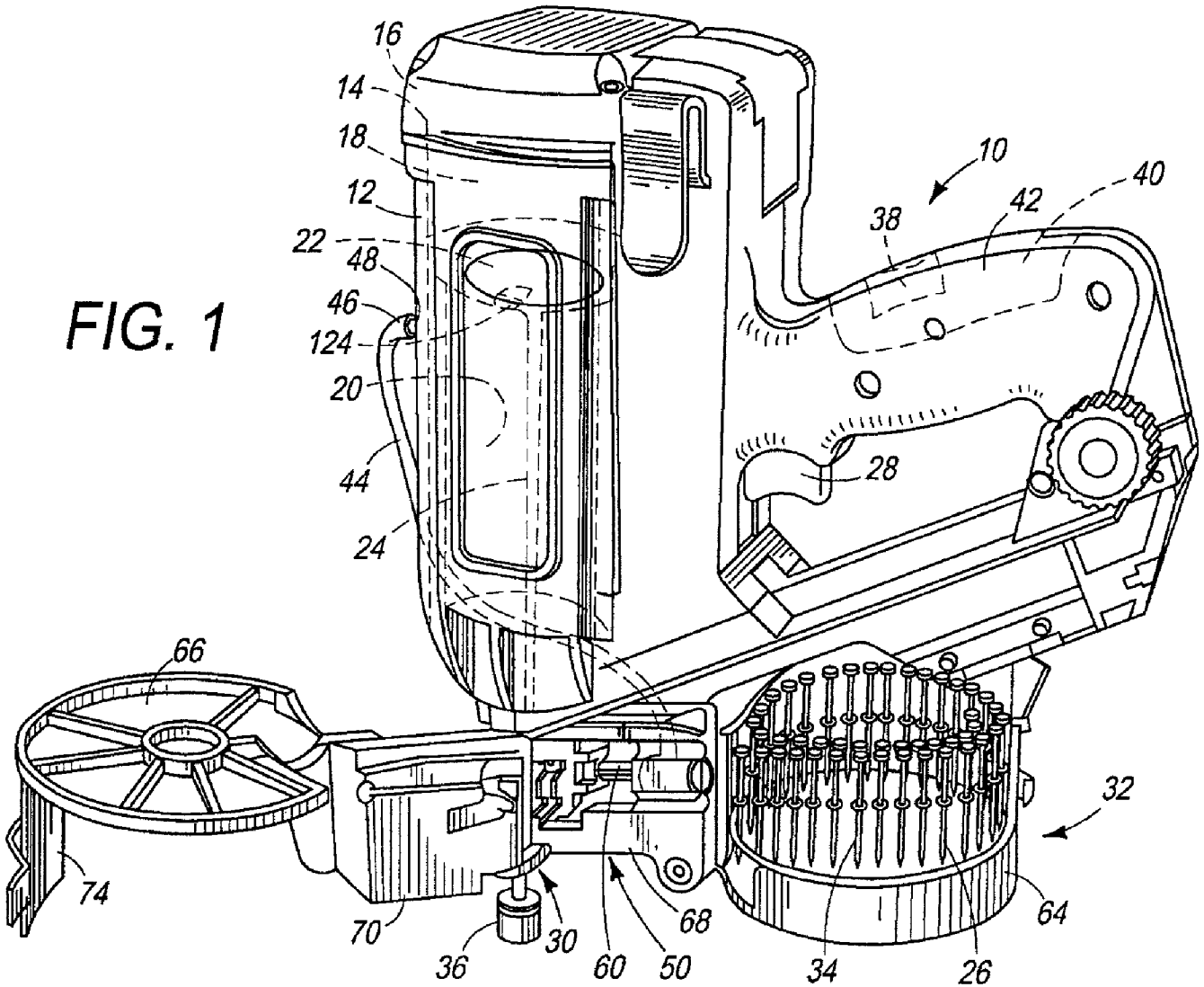
FIG. 1 is a perspective view of a fastener driving tool having a coil magazine and equipped with the present feeder mechanism retention device.

Referring now to FIGS. 1-4, a fastener driving tool of the type suitable with the present feeder mechanism is generally designated 10 and is depicted as a combustion-powered tool. The general principles of operation of such tools are known in the art and are described in U.S. Pat. Nos. 5,197,646; 4,522,162; 4,483,473; 4,483,474 and 4,403,722, all of which are incorporated by reference. However, it is contemplated that the present feeder mechanism is applicable to fastener driver tools powered by other power sources that employ a reciprocating driver blade for driving fasteners into a workpiece. Also while it should be understood that the tool 10 is operable in a variety of orientations, directional terms such as "upper" and "lower" refer to the tool in the orientation depicted in FIG. 1.

Referring to FIGS. 1-4 and 11, a housing 12 of the tool 10 encloses a self-contained internal power source 14 (FIG. 11) within a housing main chamber 16. As in conventional combustion tools, the power source 14 is powered by internal combustion and includes a combustion chamber 18 (FIG. 11) that communicates with a drive cylinder 20. A drive piston 22 reciprocally disposed within the drive cylinder 20 is connected to the upper end of a driver blade 24. An upper limit of the reciprocal travel of the drive piston 22 is referred to as a pre-firing position located at an upper end 25 of the cylinder 20, which occurs just prior to firing, or the ignition of the combustion gases that initiates the downward driving of the driver blade 24 to impact a fastener 26 to drive it into a workpiece.

Through depression of a trigger 28, an operator induces combustion within the combustion chamber 18, causing the driver blade 24 to be forcefully driven downward through a nose or nosepiece 30. The nosepiece 30 guides the driver blade 24 to strike the forward-most fastener 26 that had been delivered into the nosepiece via a fastener magazine 32. While a variety of magazines are contemplated as are known in the art, in the present tool 10 the magazine 32 is preferably a coil magazine in which the fasteners 26 are secured in a strip 34 using collating materials, typically metal, paper or plastic.

In proximity to the nosepiece 30 is a workpiece contact element 36, which is connected, through a linkage or upper probe (not shown) to a reciprocating valve sleeve (not shown), which partially defines the combustion chamber 18. Depression of the tool housing 12 against the workpiece (not shown) in a downward direction in relation to the depiction in FIG. 1, causes the workpiece contact element 36 to move from a rest position to a firing position, closing the combustion chamber 18 and preparing it for combustion. Other pre-firing functions, such as the energization of a fan in the combustion chamber 18 and/or the delivery of a dose of fuel to the combustion chamber are performed mechanically or under the control of a control circuit or program 38 embodied in a central processing unit or control module 40 (shown hidden), typically housed in a handle portion 42 (FIG. 1) of the housing 12.

Upon a pulling of the trigger 28, a spark plug is energized, igniting the fuel and gas mixture in the combustion chamber 18 and sending the drive piston 22 and the driver blade 24 downward toward the waiting fastener 26 for entry into the workpiece. A conduit 44 has an inlet end 46 connected to a wall of the drive cylinder 20 via a suitable fitting 48 for diverting combusted gases at a location between the uppermost position of the drive piston 22 and the position of the driving piston when combusted gases are exhausted from the drive cylinder 20, via exhaust ports (not shown). It will be appreciated that other locations on the power source for the inlet end 46 of the conduit 44 are contemplated, such as, but not restricted to the combustion chamber as described in U.S. Pat. No. 7,040,521 which is incorporated by reference, as well as utilization of the compressed gas generated in front of the drive piston 22. Such gases are collectively referred to as power source gases.

Figure 2:
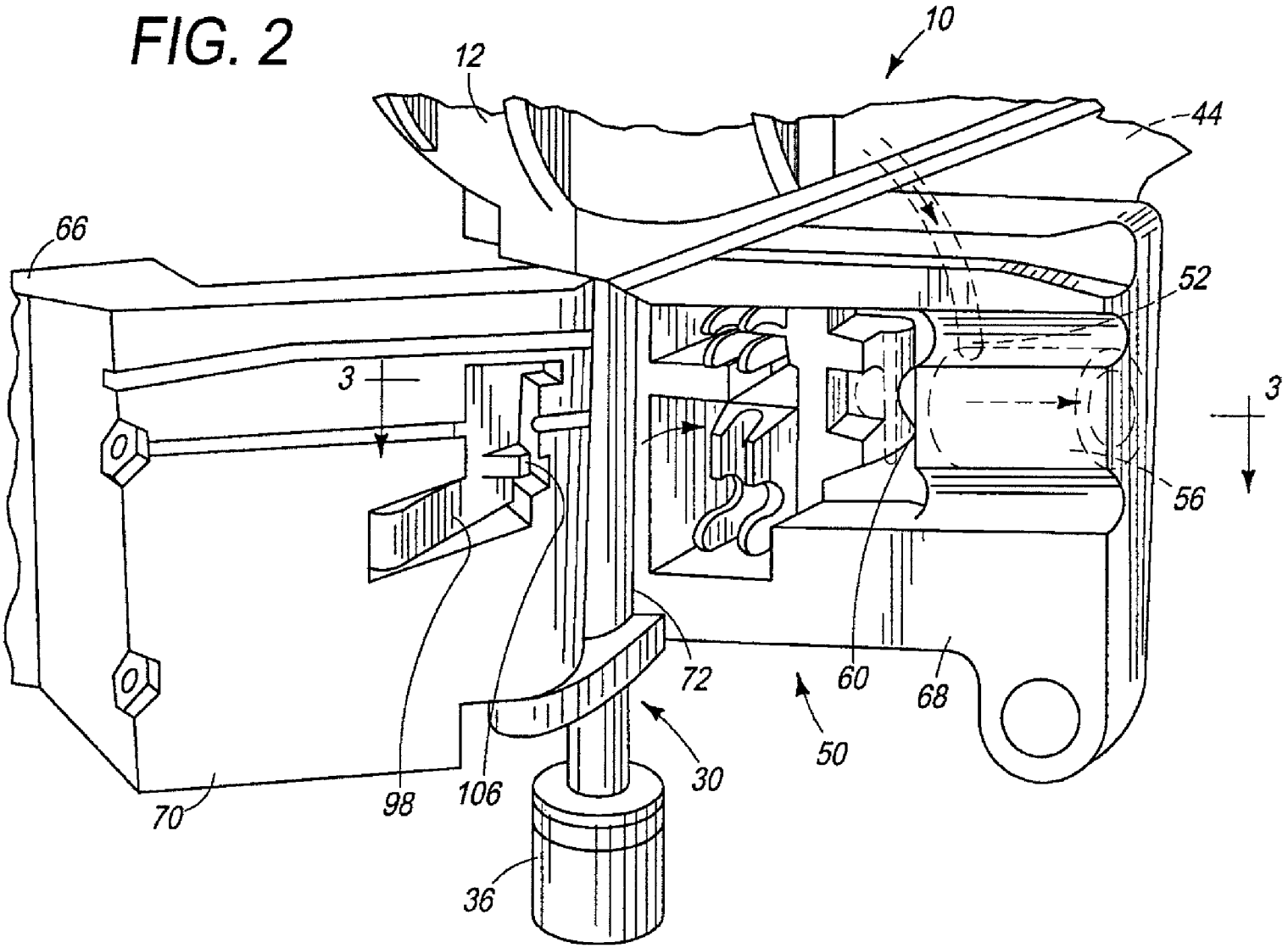
FIG. 2 is an enlarged fragmentary perspective elevation of the fastener driving tool of FIG. 1.
Figure 3:
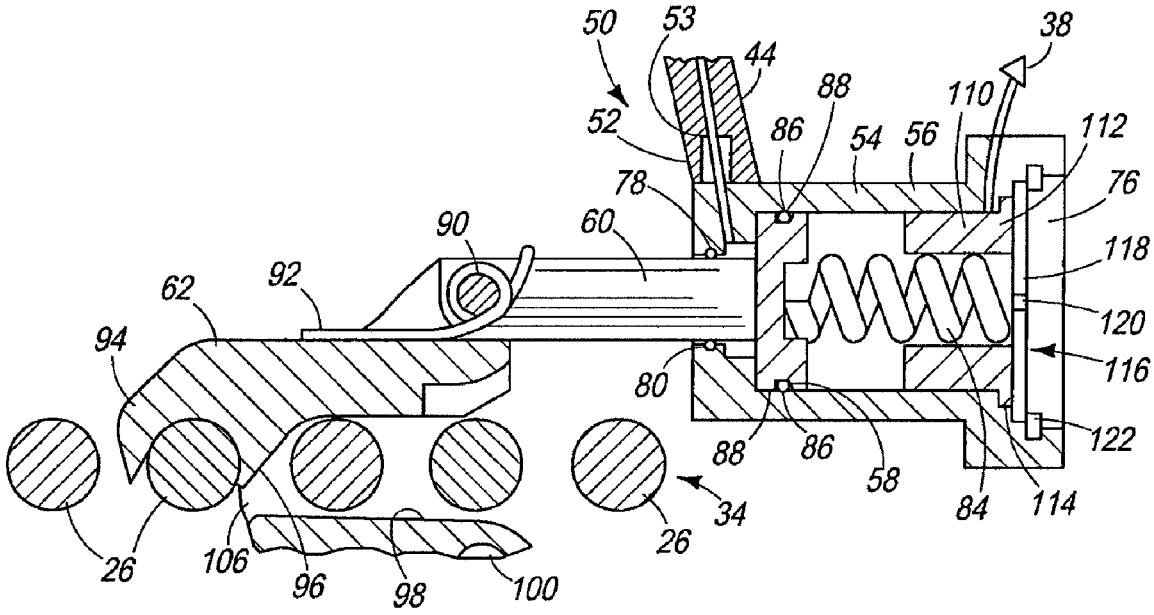
FIG. 3 is a fragmentary vertical cross-section taken along the line 3-3 of FIG. 2 and in the fully advanced position.
Figure 4:
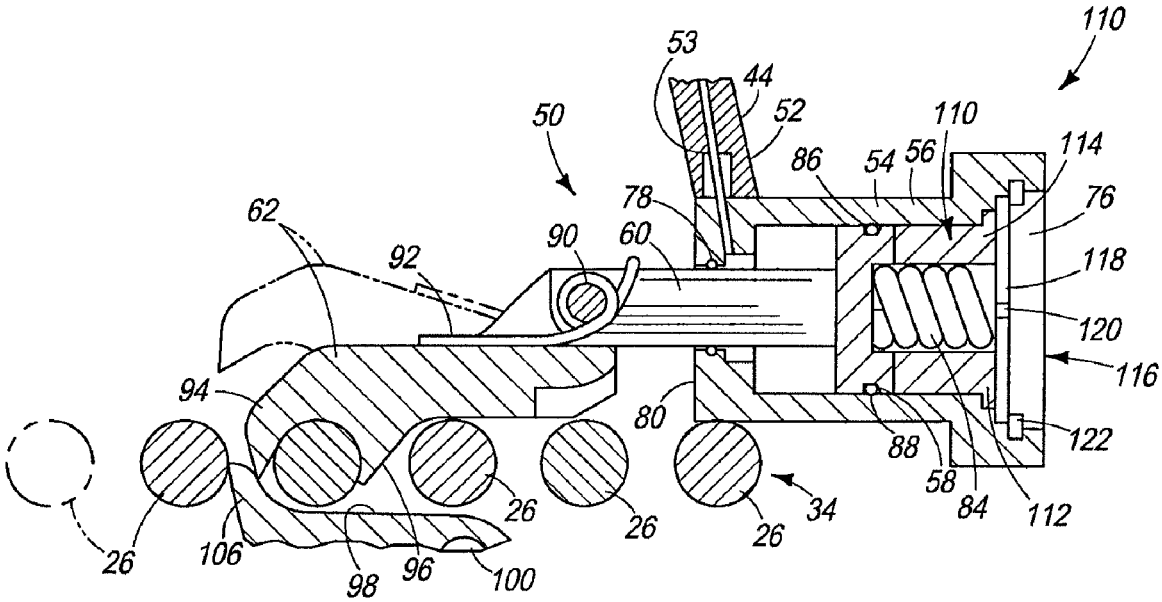
FIG. 4 is a fragmentary vertical cross-section similar to FIG. 3 depicting a fully retracted position.

As shown in FIGS. 1-5, at an opposite end from the fitting 48, the conduit 44 is connected to a fastener feeder mechanism, generally designated 50. An outlet end 52 of the conduit 44 is connected to a nipple-type fitting 53 in a cylindrical wall 54 of a feeder mechanism cylinder 56, also referred to as the feed cylinder. The conduit 44 diverts power source gas, here combustion gas from the driving cylinder 20 into the feed cylinder 56 against a feed piston 58 to move the feed piston, a piston rod 60, and a feed claw or pawl 62 from an advanced position of the feed piston (FIG. 3) into a withdrawn or retracted position of the feed piston (FIG. 4). This process is also referred to as activating the feed piston. Except as presently illustrated and described, the fastener-feeder mechanism 50 is similar to fastener feeder mechanisms provided with pneumatically powered fastener-driving tools available commercially from ITW Paslode.

More specifically, and referring to FIGS. 1 and 2, the feeder mechanism 50 includes the magazine 32 which is provided with a fixed portion 64 and a pivotable portion 66. The fixed portion 64 is fixed to the housing 12 and the nosepiece 30 via an arm 68. An arm 70 pivotably connects the pivotable portion 66 to the fixed portion 64, and the arm 70 is hinged to the arm 68 via a hinge 72, and is pivotable between an opened position, in which it is shown in FIGS. 1 and 2, and a closed position (not shown). The pivotable portion 66 is pivoted to the opened position for loading of a coiled strip 34 of fasteners 26 into the canister magazine 32 and to the closed position for operation of the tool 10 and the mechanism 50. Also included in the mechanism 50 is a latch 74 for releasably latching the pivotable portion 66 in the closed position. The arms 68, 70 combine to define a fastener-feeding track.

Figure 5:
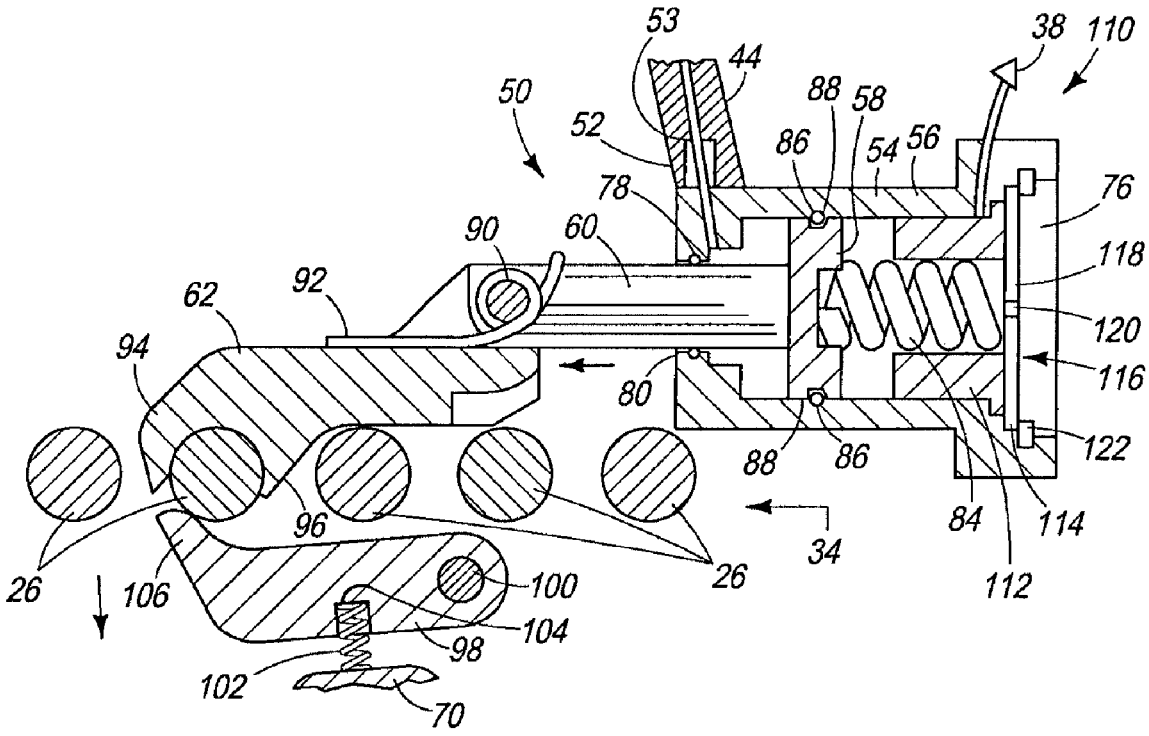
FIG. 5 is a fragmentary vertical cross-section similar to FIG. 4 depicting a subsequent advancing forward position.

Referring now to FIGS. 3-5, the mechanism 50 includes the feed cylinder 56, which is mounted fixedly to the arm 68 and which has the cylindrical wall 54, an end 76, an annular O-ring 78 fixed within the cylindrical wall 54 at an outer, apertured end 80 of the feed cylinder. The feed piston 58 is movable within the cylindrical wall 54 between a retracted position and an advanced position, and is provided with the piston rod 60. Guided by the O-ring 78 and the apertured end 80, the piston rod 60 moves commonly with the feed piston 58.

Inside the feed cylinder 56 is provided a return spring 84 which is seated against the end 76 as will be described in greater detail below, and which biases the feed piston 58 toward the advanced position. An O-ring 86 is seated in a peripheral groove 88 of the feed piston 58 and seals against the cylindrical wall 54 as the feed piston 58 reciprocates.

Also included in the feeder mechanism 50 is the feed claw 62, which is pivotably mounted to the piston rod 60 via a pivot pin 90, to be commonly movable with the piston rod and the feed piston 58 between the retracted and advanced positions but also to be pivotable on the pivot pin between an operative position and an inoperative position. In FIGS. 3-5, the feed claw 62 is shown in the operative position in unbroken lines and in the inoperative position in broken lines. A torsion spring 92 is mounted on the pivot pin 90 and biases the feed claw 62 toward the operative position.

The feed claw 62 has notched end fingers or prongs 94, which are configured for engaging one of the fasteners 26 of the strip 34 when the feed claw is in the operative position and to advance the strip when the feed piston 58, the piston rod 60, and the feed claw 62 are moved by spring pressure from the return spring 84 from the retracted position (FIG. 4) to the advanced position (FIG. 3). The notched end fingers 94 have a camming surface 96, which is configured for camming over the next nail 26 in the strip 34 to cause the feed claw 62 to pivot from the operative position into the inoperative position when the feed piston 58, the piston rod 60, and the feed claw are moved by gas pressure from the conduit 44 from the advanced position to the retracted position.

Also included in the feeder mechanism 50 is a holding claw 98, which is mounted pivotably to the arm 70 via a pivot pin 100 to be pivotable between an engaging position and a disengaging position. The holding claw 98 is shown in the engaging position in FIGS. 3 and 4, and in the disengaging position in FIG. 5. A coiled spring 102, which has one end seated in a socket 104 in the holding claw 98 and its other end bearing against the arm 70, biases the holding claw to the engaging position. The holding claw 98 has distal end fingers 106, which are adapted to fit between two nails 26 of the strip 34, to engage and hold the nail so that the strip, including the engaged nail, does not move with the feeding claw 62 when the feed piston 58, the piston rod 60, and the feed claw are moved to the retracted position by the combustion gases.

Referring again to FIGS. 3-5, to address the above-described problem of the next fastener 26 to be driven being urged against the driver blade 24 during the driver blade return cycle, the present feeder mechanism 50 is provided with a retention device, generally designated 110. The retention device 110 holds the feed piston 58 in place in the retracted position (FIG. 4) and prevents the unwanted side loading on the driver blade 24, thus permitting more repeatable and rapid piston return. In the preferred embodiment, the retention device 110 uses an electromagnet 112 that is electrically connected to the control program 38 which determines its energization cycle. However, other types of electromechanical retention devices that act on the feeder mechanism are contemplated, provided they are able to prevent side loading against the driver blade 24 by the next fastener 26 through urging of the feed piston 58 during driver blade return cycle.

Also, it is preferred that the electromagnet 112 is disposed within the feed cylinder 56 and is secured therein by a flange 114 engaging a corresponding shoulder of the feed cylinder and fastener hardware 116 placed in the end 76 of the feed cylinder 56. In the preferred embodiment the fastener hardware 116 is a disc 118, with a vent hole 120, and a spring clip 122 secured in the feed cylinder 56. The vent hole 120 allows the escape of air from the feed cylinder 54 when the feed piston 58 is retracted. It is understood that other fastening technologies are contemplated for securing the electromagnet 112 in place, including but not limited to threaded engagement, chemical fasteners, welding and the like. The electromagnet 112 is secured in place to withstand the spring force generated by the return spring 84 when compressed, and the energization of the electromagnet is sufficient to overcome the biasing force of the return spring acting on the feed piston 58.

The control program 38 controls the energization of the electromagnet 112, which holds the feed piston 58 for a sufficient period of time, until the drive piston 22, and the driver blade 24 are clear of the tool nose 30. The time varies with the tool and the application, but is sufficiently long for the drive piston 24 returning to the pre-firing position. In one application, the designated energization time of the electromagnet 112 is approximately 100 msec; however other times are contemplated, depending on the tool and the situation.

As an alternate configuration, the drive piston 22 and or the cylinder 20 can be monitored with at least one piston position sensor 124 (shown schematically and hidden in FIG. 1) to provide feedback to the control program 38 to de-energize the electromagnet 112 when the drive piston and driver blade 24 has returned to the pre-firing position.

Figure 6:
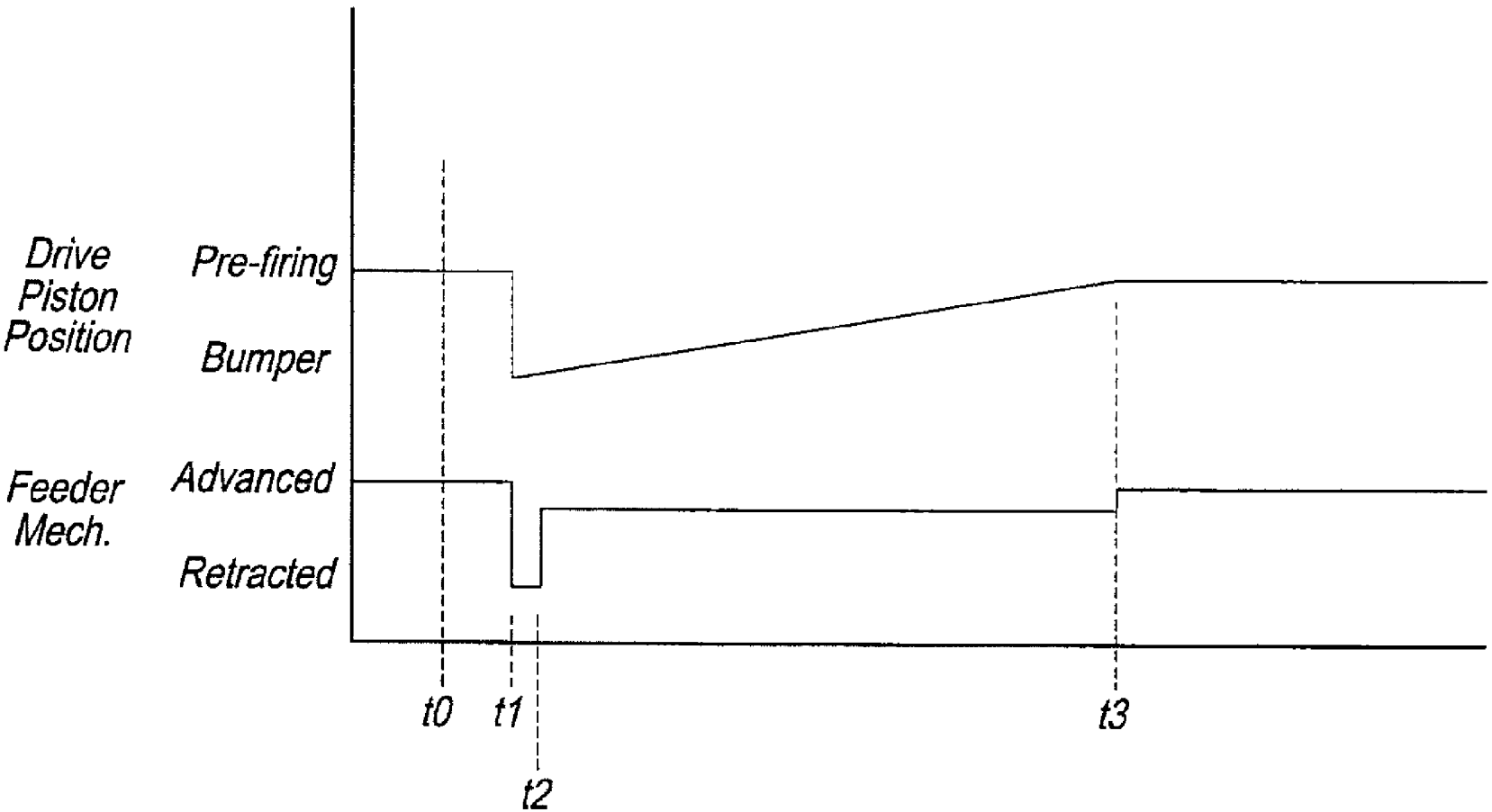
FIG. 6 PRIOR ART
FIG. 6 is a prior art timing chart of a conventional fastener driving tool provided with combustion-derived compressed gas power for the fastener feeder.

Referring now to FIG. 6, the timing of prior art tools is depicted. At t0, the tool 10 has not been fired and the drive piston 22 is in the pre-firing position at an upper end of the drive cylinder 20. Also, the feed piston 58 is in the advanced position (FIG. 3), and a fastener 26 is positioned in the nose 30. At t1, upon firing, the drive piston 22 and the driver blade 24 travel down the cylinder 20, and a portion of the power source gas, here combustion gas is diverted through the conduit 44 causing the feed piston 58 to retract. The feed piston 58 is retracted from t1 to t2 until the gases disburse, then the feed piston 58 returns towards the advanced position powered by the return spring 84 at t2. It will be seen that between t2 and t3, the feed piston is not fully advanced, and is urging the next fastener 26 against the driver blade 24 until it reaches the pre-firing position. At t3, the driver blade 24 has cleared the fastener 24 and has reached the pre-firing position. Also at t3 since the nose area is cleared, the feeder mechanism 50 advances the fastener 26 all the way into the nose 30. As discussed above, the side loading of the fastener 26 against the driver blade 24 slows the return of the piston 22 to the pre-firing position.

Figure 7:
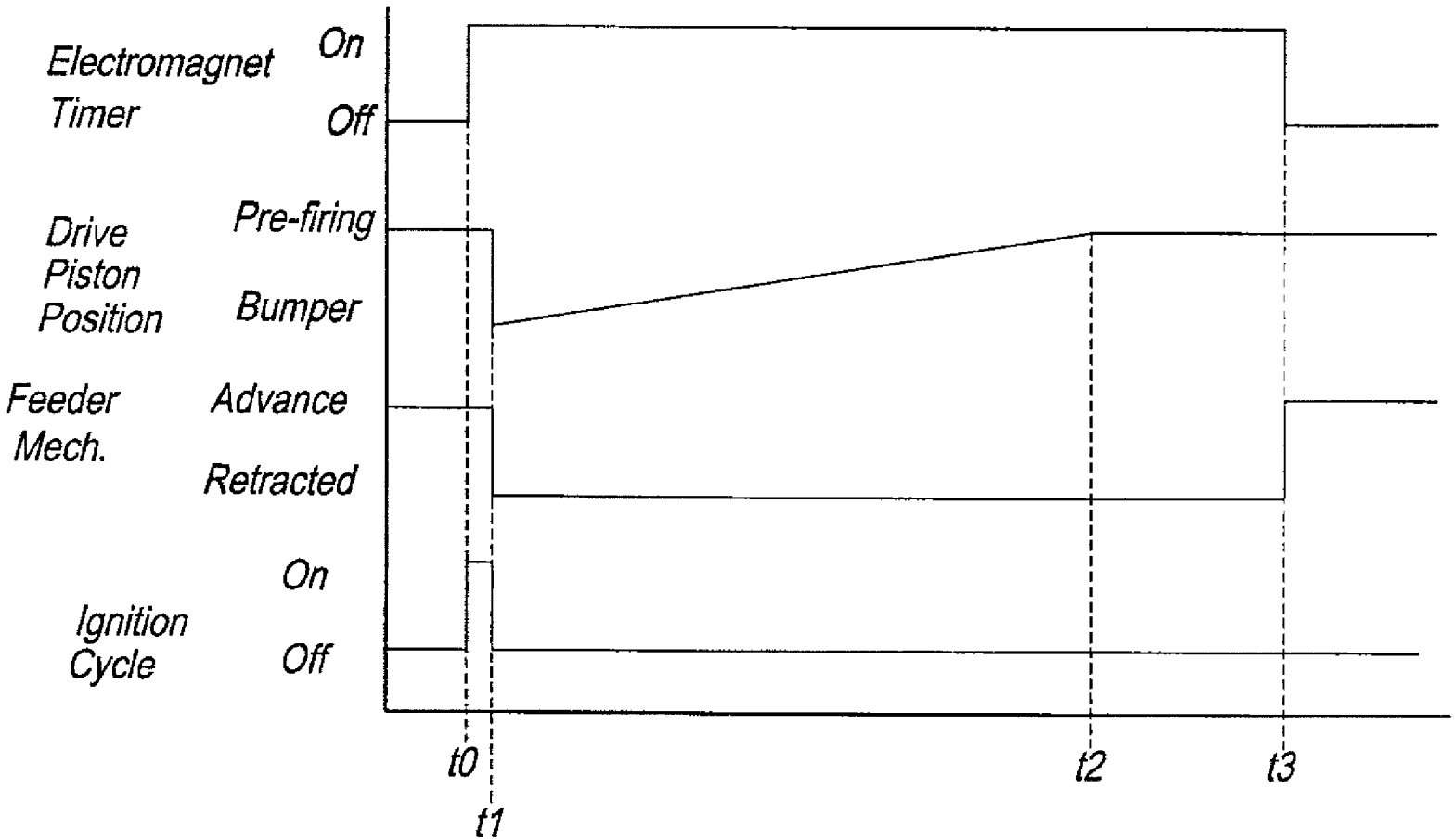
FIG. 7 is a timing chart of a tool provided with the present feeder mechanism.

Referring now to FIG. 7, the operational sequence of the present tool 10 equipped with the retention device 110 is depicted. The electromagnet 112 is energized by the control program 38 at t0 with the start of the ignition cycle of the tool 10. This causes the electromagnet 112 to be energized and ready to secure the feed piston 58 when it contacts electromagnet 112 in the retracted position (FIG. 4) due to the ferrous material used to manufacture the feed piston. The control program 38 includes a timer function which maintains power to the electromagnet 112 until the timer expires at t3. While the ignition event preferably energizes the timer, a number of other means can be used to begin the timer, including but not limited to a switch, such as the trigger switch 28 or a chamber position switch (not shown). When ignition occurs at t1, combustion gases advance the drive piston 22 to the bumper position during which a fastener is driven. At that time, as occurred in FIG. 6, partial combustion gases are diverted to the conduit 44 and fully retract the feed piston 58 also shown at t1. Although the events at t1 are not simultaneous, they are relatively short in duration and shown as a single time event.

However, unlike the operation of the prior art tool in FIG. 6, in the present tool, through the function of the electromagnet 112, the feed piston 58 is held in the retracted position (FIG. 4) by the control program 38 until t3, which is sufficiently after the drive piston 24 returning to the pre-firing position at t2. Due to the gap between t2 and t3, the time period for energization of the electromagnet 112 may exceed the piston return time, depending on the tool and the application. Upon expiration of the timer, the electromagnet 112 is deenergized, and the return spring 84 forces the feed piston 58 to the advanced position (FIG. 5), which causes the advancement of the next fastener 26.

Referring now to FIGS. 8-13, an alternate embodiment of the tool 10 is generally designated 130. It will be appreciated that components shared with the tool 10, including the magazine 32, the fastener feed mechanism 50, the feed piston 58 and the retention mechanism 110 among other components, are all designated with identical reference numbers in the tool 130.

An important distinguishing feature of the tool 130 is that the inlet end 46 of the conduit 44 is connected to a port 132 mounted in the cylinder 20 a distance "D" (FIG. 12) from the pre-firing position 25. The distance "D" is determined by the effect of the gas or gases provided through the conduit 44 to the feed mechanism 50, specifically to the feed cylinder 56, where the gas is ultimately used to activate or retract the feed piston 58 toward the electromagnet 112.

Figure 10:
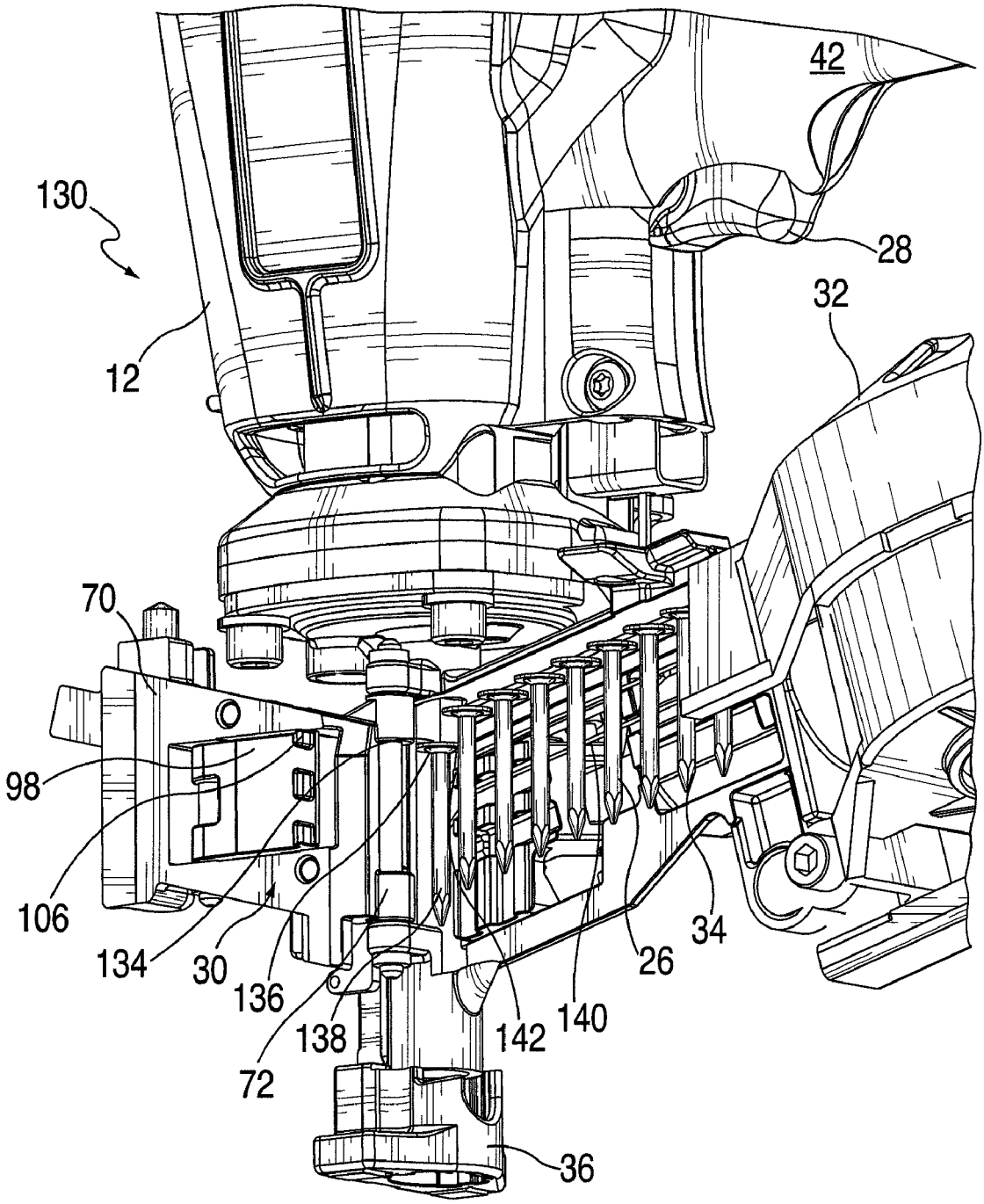
FIG. 10 is a fragmentary side perspective view of the tool of FIG. 9 shown with the driver blade engaging the fasteners for breaking the collation.

In the preferred embodiment, the distance "D" is reflective of a delay of feeding the gas to the feed piston 58 at least until engagement between an end 134 of the driver blade 24 and a head 136 of a first fastener 138 in the tool nosepiece 30 (FIG. 10). The first fastener 138 is one of the fasteners 26 in the strip 34.

One of the functions provided by the feed piston 58 is that, due to its being loaded or biased by the return spring 84, the piston exerts a forward loading, through the feed claw 62 upon the fasteners 26 in the nosepiece 30 (FIG. 5). This loading provides a stabilizing force to hold the first fastener 138 in position for receiving the impact from the driver blade end 134. When the feed piston 58 is prematurely retracted toward the electromagnet 112 (FIG. 4), this loading is removed, and the first fastener 138 is unstable in the nosepiece 30. Such instability has resulted in misalignment or jamming of fasteners in the nosepiece, as well as misaligned or otherwise improperly driven fasteners.

Thus, the present positioning of the port 132 is calculated to delay the delivery of gases to the feed mechanism 50 to activate or retract the feed piston 58 only after the driver blade end 134 has impacted the fastener 138, which is when the stabilizing force is no longer needed.

Figure 8:
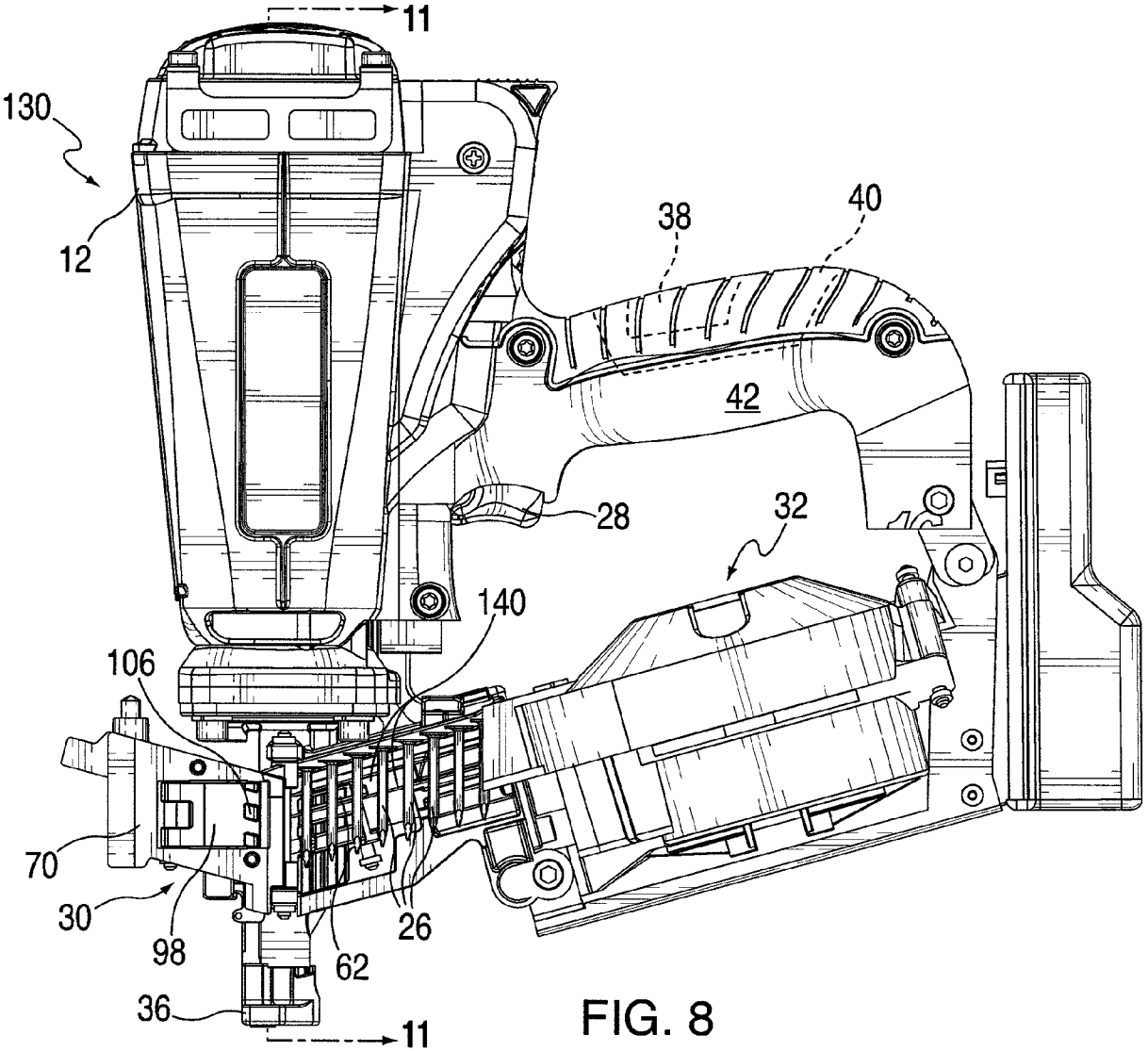
FIG. 8 is a side elevation of an alternate embodiment of the present tool showing the nose opened for viewing fasteners being urged forward by the feeder mechanism.
Figure 9:
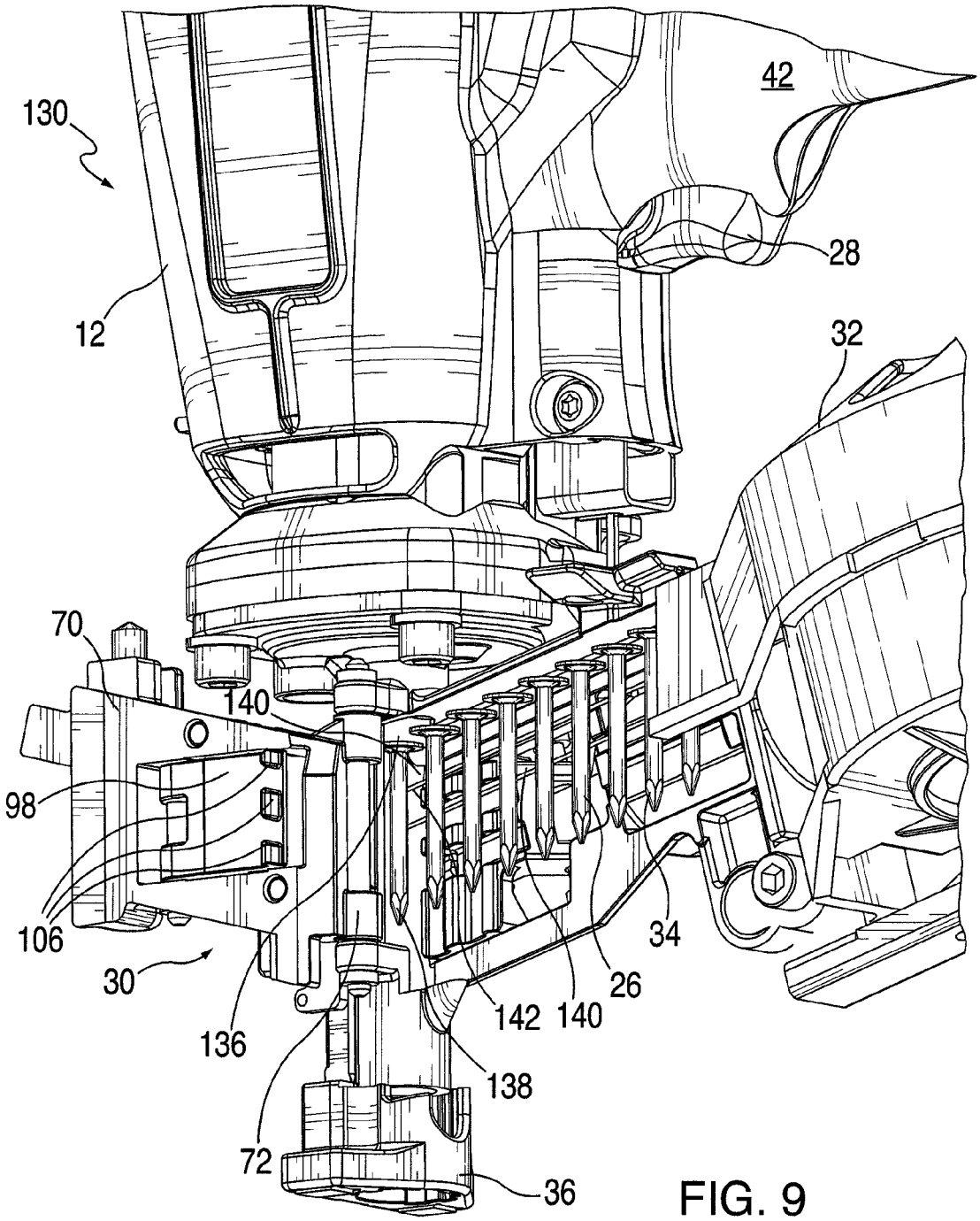
FIG. 9 is a fragmentary side perspective view of the tool of FIG. 8 prior to fastener driving.

Referring now to FIGS. 8 and 9, the relationship is shown between the fasteners 26, the first fastener 138 and collation media 140; here parallel wires, but paper or plastic collation media is also contemplated. Referring now to FIG. 10, after combustion, the driver blade end 134 projects into the tool nosepiece 30, impacts the fastener head 136 and begins to bend the collation media 140. Further downward progression of the driver blade end 134 will break or shear the collation media, which occurs approximately at a point 142 where the driver blade end passes the upper finger or prong 94 of the feed claw or pawl 62. It is contemplated that the retraction of the feed piston 58 caused by gas flowing through the conduit 44 to the feed mechanism 50, should be delayed at least until the driver blade end 134 impacts the fastener head 136, and more preferably when the collation media 140 begins to break, and even more preferably when the driver blade end passes the upper feed pawl prong 94 to break the collation media. Thus, the distance "D" is adjusted accordingly to achieve one of the above-identified preferred effects which maintain support of the first fastener 138 in the tool nose 30.

As is the case with the tool 10, the tool 130 is provided with the retention device 110 including the electromagnet 112, which operates the same in both tools. The distance "D" of the port 132 below the pre-firing position 25 corresponds to a point where gas is fed to the feed piston 58 so that the feed piston retracts toward the electromagnet 112 only after the driver blade 24 has impacted the fastener 138 in the nosepiece 30. Also, as is the case with the tool 10, in the tool 130, the control module 40 controls the energization or operation of the electromagnet 112.

Figure 11:
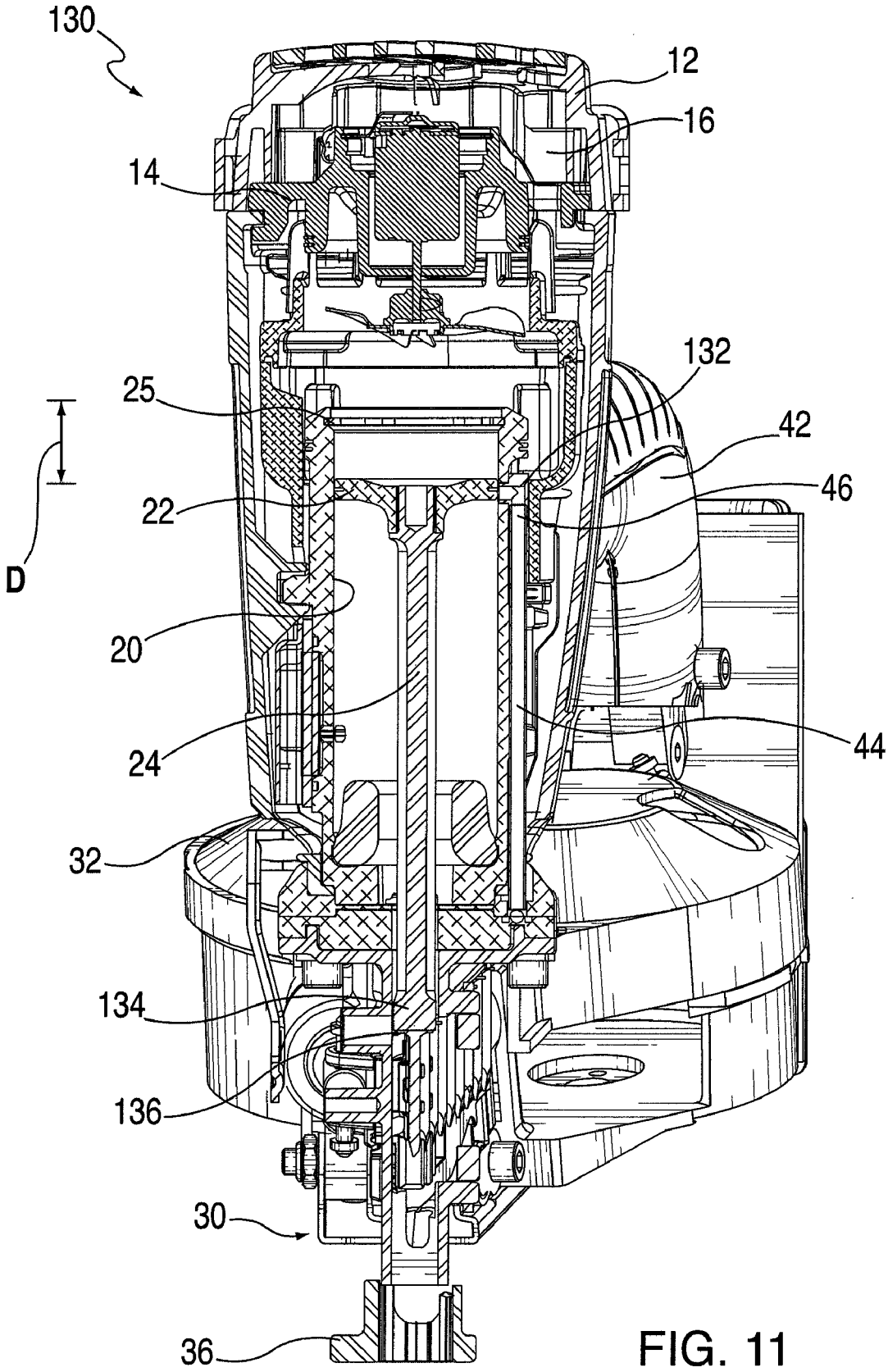
FIG. 11 is a vertical section taken along the line 11-11 of FIG. 8 in the direction indicated.
Figure 12:
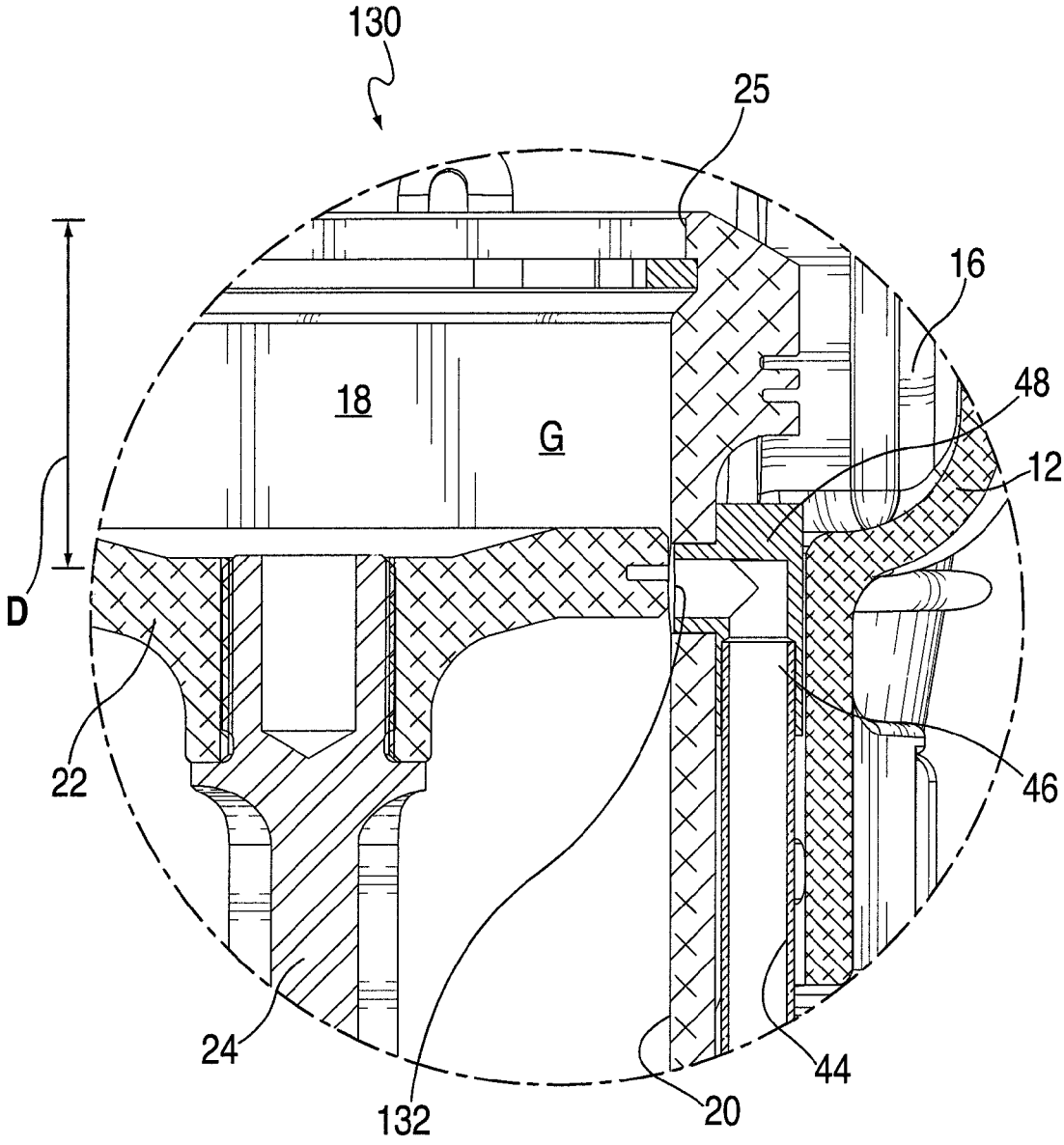
FIG. 12 is an enlarged fragmentary section of the tool of FIG. 11 shown in a pre-combustion position.
Figure 13:
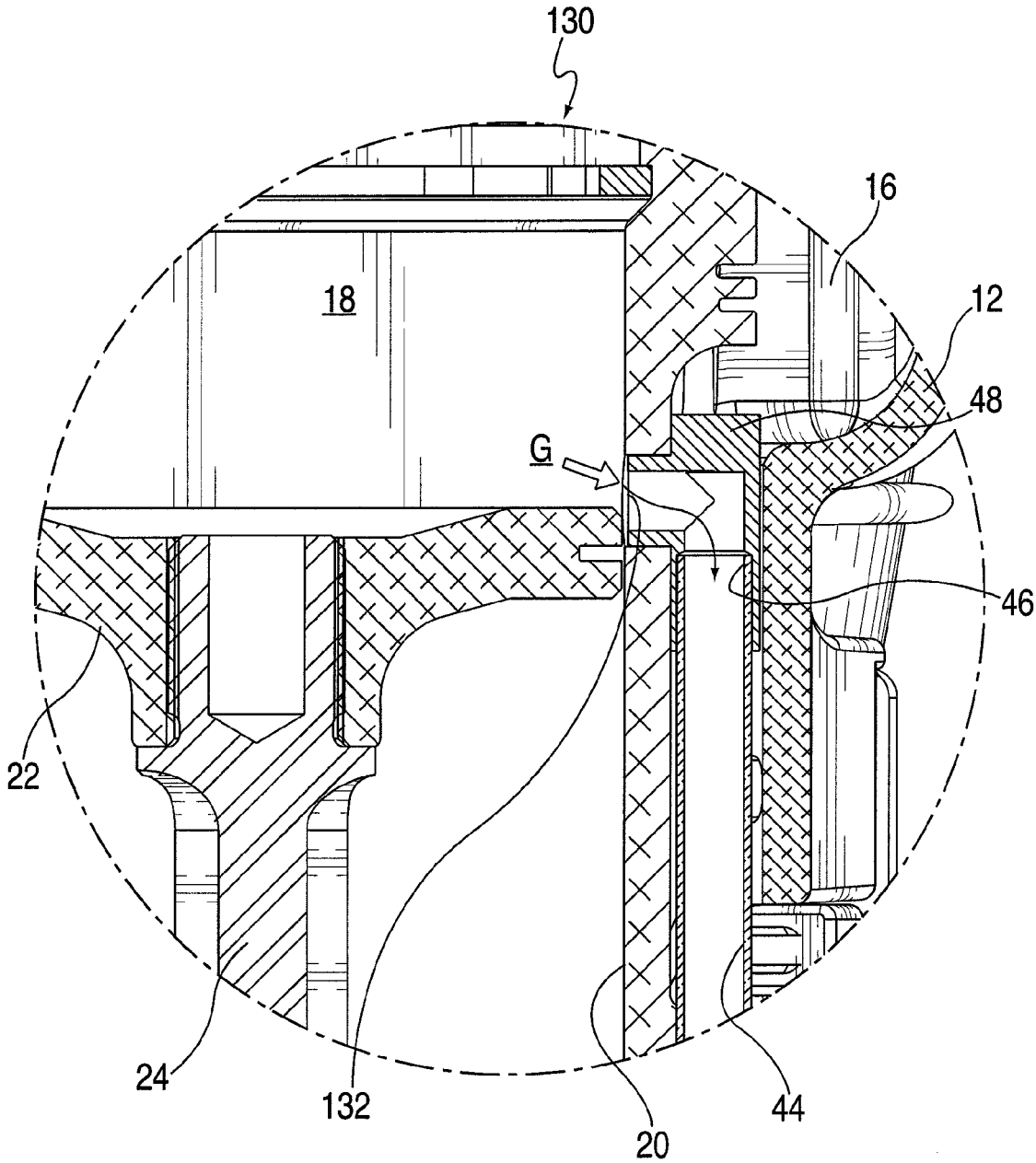
FIG. 13 is an enlarged fragmentary section of the tool of FIG. 11 shown in a post combustion position.

Referring now to FIGS. 11-13, the position of the port 132 relative to the piston 22 is shown. In FIGS. 11 and 12, combustion has occurred, and the piston 22 is progressing down the cylinder 20, with combustion gases "G" located above the piston. However, at this point, the gases "G" have not yet reached the port. As seen in FIG. 11, the driver blade end 134 has impacted the head 136 of the first fastener 138.

Referring now to FIG. 13, as the piston 22 progresses farther down the cylinder 20, of course the driver blade 24 will also extend farther into the nosepiece 30. In this drawing, the piston 22 has passed the port 132, opening fluid communication between the combustion chamber 18 and the gases "G" and the conduit 44, here shown built into the main chamber 16. At this point, the gases "G" will proceed through the conduit 44 to retract the feed piston 58. This means that the feed piston 58 is retracted only after the drive piston 22 has completed its driving cycle, has broken the collation media 140, driven the fastener, and has begun to return to the pre-firing position.

Thus, it will be seen that the tool 130 provides a relatively precise system for locating the port 132 for meeting the competing goals of having sufficient pneumatic force from the gases "G" to retract the feed piston 58 and also providing sufficient fastener stability in the nosepiece 30 through the biasing force of the return spring 84. By spacing the port 132 the distance "D" so that retraction of the feed piston 58 is delayed at least until the driver blade end 134 impacts the fastener head 136, both of these goals are achieved.

While a particular embodiment of the present fastener feeder delay for a fastener driving tool has been described herein, it will be appreciated by those skilled in the art that changes and modifications may be made thereto without departing from the invention in its broader aspects and as set forth in the following claims.

The invention claimed is:

1. A fastener driving tool, comprising:

a power source including a cylinder, a piston with a driver blade reciprocating in said cylinder;

a tool nose associated with said power source for receiving said driver blade for driving fasteners fed into said nose;

a magazine constructed and arranged to house a supply of the fasteners;

a magazine feeder mechanism associated with said magazine for sequentially feeding fasteners into said nose, said feeder mechanism including a reciprocating feed piston;

a conduit connected between a port in said cylinder and said feeder mechanism for diverting combusted gas from said cylinder for activating said feed piston; and said port disposed in said cylinder a specified distance below a piston prefiring position, said distance being reflective of a delay of feeding said gas to said feed piston at least until engagement between an end of said driver blade and a head of a fastener in said tool nose.

2. The tool of claim 1, wherein said tool nose including at least one feed pawl prong, and said specified distance representing a delay in actuation of said feed piston until an end of said driver blade passes said feed pawl prong.

3. The tool of claim 1, wherein fasteners in said tool magazine are connected to each other with a collation media, and said specified distance of said port below said pre-firing position corresponds to a point where gas is fed to said feed piston so that said feed piston retracts only after said driver blade begins to shear the collation media.

4. The tool of claim 1, wherein fasteners in said tool magazine are connected to each other with a collation media, and said specified distance of said port below said pre-firing position corresponds to a point where gas is fed to said feed piston so that said feed piston retracts only after said driver blade shears the collation media.

5. The tool of claim 1, wherein said distance of said port below said pre-firing position corresponds to a point where gas is fed to said feed piston so that said feed piston retracts only after said piston has completed a fastener driving stroke.

6. The tool of claim 1, further including an electromechanical retention device operationally associated with said feeder mechanism and configured for retaining said feed piston in a retracted position until said driver blade is positioned to allow fastener advancement into said nose.

7. The tool of claim 6, wherein said distance of said port below said pre-firing position corresponds to a point where gas is fed to said feed piston so that said feed piston retracts toward said electromechanical retention device only after said driver blade has impacted a fastener in said nose.

8. The tool of claim 6 further including a control module, wherein said control module controls the operation of said electromechanical retention device.

9. The tool of claim 1 wherein said feed piston exerts a biasing force on said fasteners in said nose for stabilizing said fasteners prior to impact by said driver blade, said distance being determined to prevent directing said gas toward said feed piston until said drive blade impact on the fastener for maintaining fastener alignment in said nose.

10. A fastener driving tool, comprising:

a power source including a cylinder, a piston with a driver blade reciprocating in said cylinder;

a tool nose associated with said power source for receiving said driver blade for driving fasteners fed into said nose;

a magazine constructed and arranged to house a supply of the fasteners, the fasteners being connected to each other by collation media;

a magazine feeder mechanism associated with said magazine for sequentially feeding fasteners into said nose, said feeder mechanism including a reciprocating feed piston;

a conduit connected between a port in said cylinder and said feed mechanism for diverting combusted gas from said cylinder for activating said feed piston; and said port disposed in said cylinder a specified distance below a piston prefiring position, said distance being reflective of a delay of feeding said gas to said feed piston at least until sufficient engagement between an end of said driver blade and a head of a fastener in said tool nose for breaking the collation media.

11. The tool of claim 10, further including an electromechanical retention device operationally associated with said feeder mechanism and configured for retaining said feed piston in a retracted position until said driver blade is positioned to allow fastener advancement into said nose.

12. The tool of claim 11, wherein said distance of said port below said pre-firing position corresponds to a point where gas is fed to said feed piston so that said feed piston retracts toward said electromechanical retention device only after said driver blade has impacted a fastener in said nose.

* * * * *